United States Patent [19]

MacIntyre et al.

[11] Patent Number: 4,957,313

[45] Date of Patent: Sep. 18, 1990

[54] EMERGENCY SUSPENSION SYSTEM FOR DRILL CASINGS

[75] Inventors: Brian MacIntyre, Milngavie; Sean McAvoy, Coatbridge; Frank Close, Airdrie, all of Scotland

[73] Assignee: Cooper Industries, Inc., Houston, Tex.

[21] Appl. No.: 366,766

[22] Filed: Jun. 14, 1989

[30] Foreign Application Priority Data

Jun. 21, 1988 [GB] United Kingdom ..... 8814699

[51] Int. Cl.[5] ..... F16L 21/00

[52] U.S. Cl. ..... 285/144; 285/339; 188/67

[58] Field of Search ..... 285/140, 144, 145, 146, 285/147, 339, 104; 166/88, 243; 403/105, 314, 409.1; 188/67

[56] References Cited

U.S. PATENT DOCUMENTS

| | | | |
|---|---|---|---|
| 1,754,132 | 4/1930 | Bekkum | 188/67 X |
| 1,827,257 | 10/1931 | Parker | 285/140 X |
| 1,933,935 | 11/1933 | Santiago | 285/140 X |
| 2,182,797 | 12/1939 | Dillon | 285/104 X |
| 2,283,975 | 5/1942 | Dillon | 285/104 |
| 2,463,235 | 3/1949 | Andrews | 285/105 |
| 3,067,820 | 12/1962 | Green | 285/144 X |
| 3,653,688 | 4/1972 | Sakakibara | 285/105 |

FOREIGN PATENT DOCUMENTS

| | | | |
|---|---|---|---|
| 988810 | 5/1951 | France | 188/67 |
| 580046 | 7/1950 | Italy | 285/105 |
| 2146091 | 4/1985 | United Kingdom . | |

*Primary Examiner*—Dave W. Arola

*Attorney, Agent, or Firm*—Ned L. Conley; David A. Rose; William E. Shull

[57] ABSTRACT

The invention provides an emergency suspension system for use particularly with drill casings in a wellhead. The system, which is intended to surround the casing, comprises an annular bowl member (6) having an internal tapered annular space (16) which reduces in diameter from its upper to its lower end and a support means comprising an annular support element arrangement (28) at least partially formed from resilient material and a plurality of support members (20,22,24) at least partially embedded in said resilient material and having a circular cross-section in at least one direction, said members forming a plurality of annular arrays adapted to surround said tubular member, the uppermost of said arrays (20) comprising support members having said circular cross-section larger than that of a lowermost (24) of said arrays.

18 Claims, 3 Drawing Sheets

EMERGENCY SUSPENSION SYSTEM FOR DRILL CASINGS

This invention is concerned with improvements in or relating to an emergency suspension system for drill casings of the type which is commonly used in the drilling of oilwells in subterranean or sub-sea conditions.

It is common practice in the drilling of oilwells for cylindrical tubular drill casings to be sunk into the ground in a borehole. Such drill casings consist of a plurality of tubular sections which are screw-threadedly interconnected with each other. In many cases, the tubular sections of drill casing are connected together by means of an internally screw-threaded collar which is screwed on to external screw-threaded end portions of adjacent casing sections Such interconnecting collars project radially outwardly of the outside diameter of the drill casings.

The drill casings are commonly sunk significant distances into the ground e.g. 3000 meters (10,000 feet) and it sometimes happens that during a drilling operation, the drill casing becomes stuck due, for example, to collapse of the surrounding borehole. In such circumstances it is necessary to support the drill casing at an intermediate location or locations in order to ensure that the casing does not suddenly drop down if the blockage clears. In such a situation a heavy duty crane may be used to support the casings, but because of their great weight it is necessary to reduce the strain on the crane. One way of achieving this is to use a device commonly known as a "slip". Existing slips frequently consist of a "bowl" section and a "slip" section. The bowl is commonly a two piece component held together by means of cap screws. The slip section is commonly a four piece component which fits within the bowl section. The inside diameter of the bowl section and the outside diameter of the slip section have mating taper faces. The inside diameter of the slip section have a series of annular serrated rings. The action of the assembly is such that when the casing engages in the serrated rings, the slip section is pulled down the tapered face of the bowl section and provides a wedge which in turn suspends the casing.

Existing slips are effective but have certain disadvantages. For example, they are relatively expensive to manufacture. In addition, they cannot easily be located about a drill casing at a remote location due to the lack of space surrounding the drill casing. This is especially true of those devices incorporating a hinged construction. Also, if the drill casing has externally projecting collars interconnecting adjacent sections of casing, it is not always possible to manipulate the slips over the projecting collars.

An object of the present invention is to provide an alternative method of suspension for a drill casing and in which the foregoing disadvantages are obviated or mitigated.

According to the present invention there is provided a suspension system for use in supporting a tubular member such as a drill casing for use in a wellhead, comprising an annular bowl member having an internal tapered annular surface which reduces in diameter from its upper to its lower end and a support means comprising an annular support element arrangement at least partially formed from resilient material and a plurality of support members at least partially embedded in said resilient material and having a circular cross-section in at least one direction, said members forming a plurality of annular arrays adapted to surround said tubular member, the uppermost of said arrays comprising support members having said circular cross-section larger than that of a lowermost of said arrays.

Advantageously, the support element arrangement may comprise a plurality of arcuate elements.

Preferably, there may be provided at least three arrays of support members, the diameter of the circular cross-section of the members of each array decreasing stepwise from the diameter of those of the uppermost array to those of the lowermost array. Conveniently the support members may be spherical or cylindrical, ball or roller-bearings which may be embedded or partially embedded in the resilient material. In an example of the invention the resilient material is enclosed by a rigid shell portion of the support element. Advantageously, the support element shell portion is provided with a frustoconical, external surface portion, the bowl member having a corresponding frustoconical internal surface portion adapted to be engaged thereby in a wedging manner.

Two embodiments of the present invention will now be described, by way of example, with reference to the accompanying drawings, in, which:

Figure 1:
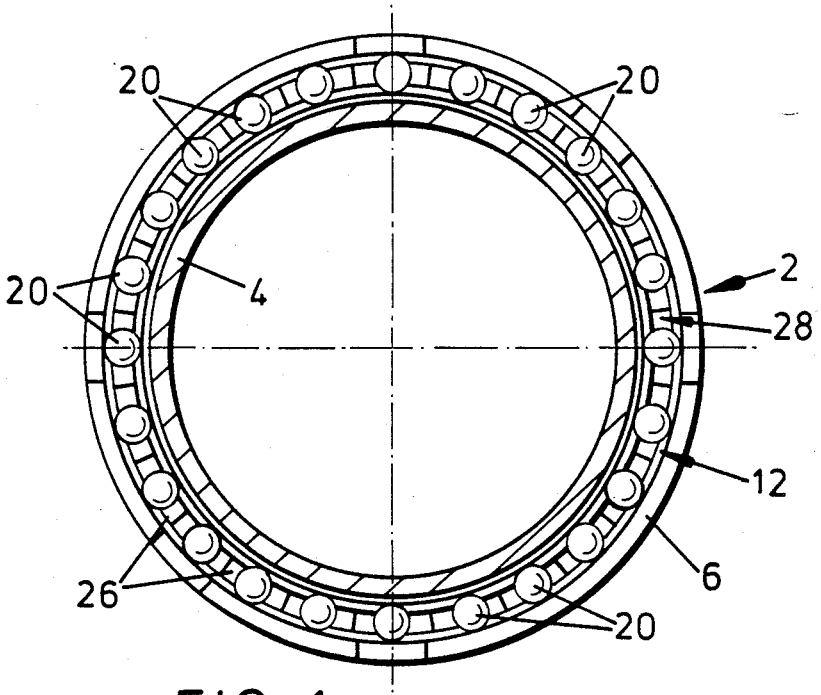
FIG. 1 is a plan view of a first support assembly for a drill casing in accordance with the present invention.
Figure 2:
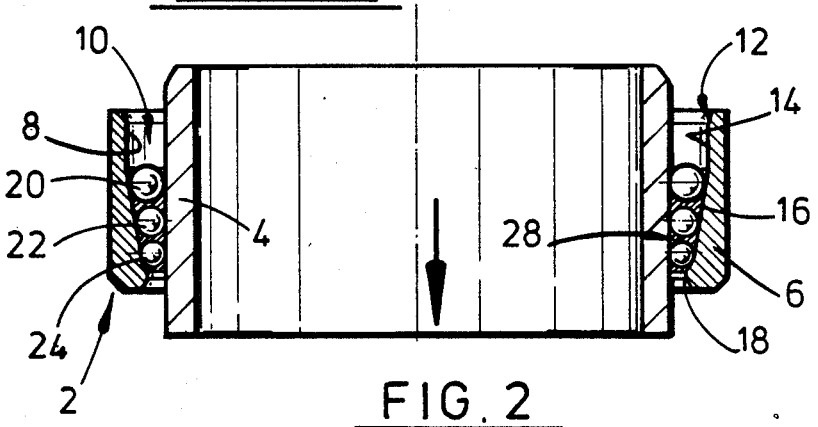
FIG. 2 is a vertical sectional view of the support assembly of FIG. 1.

Referring to FIGS. 1 and 2, there is shown a support assembly 2 adapted to be located around a drill casing 4. The drill casing 4 is of tubular form and the support assembly is located therearound in order to grip the drill casing and prevent it moving downwardly in the direction of the arrow shown in FIG. 2.

The support assembly consists of a cylindrical bowl 6 having a constant outer diameter. The internal cylindrical surface 8 of the bowl 6 is of greater diameter than the outer diameter of the casing 4 so as to define a space 10 therebetween. The upper end of the internal surface 8 of the bowl 6 is provided with an outwardly flared taper 12 which leads into a portion 14 which is of constant diameter and which merges into a tapered surface 16 which continuously reduces in diameter towards the lower end of the bowl where it terminates in a lip 18.

Located between the internal tapered surface 16 of the bowl 6 and the outer diameter of the casing 4, are three annular arrays of spherical members, each array 20,22 and 24 consisting of a series of support elements in the form of steel balls at spaced locations around the bowl 6 and adapted to be in contact with the external circumference of the drill casing 4. The balls 20 of the upper array (see FIG. 2) are of greater diameter than those of the balls 22 of the intermediate array and these in turn are of greater diameter than the balls 24 of the lower array.

When located in the operative position as shown in FIG. 2, downward movement of the drill casing 4 is prevented by the wedging action of the balls 20,22,24 of each array between the outer diameter of the casing 4 and the internal tapered surface 16 of the bowl 6.

It will be noted that the lowermost lip 18 of the internal surface of the bowl 6 is radially spaced from the outer diameter of the drill casing 4.

As can be seen best from FIG. 1 of the drawings, the support elements 26 are formed in a series of segments, each segment comprising an elastomeric carrier 28 (FIG. 2) in which there is embedded a large diameter ball 20 to form a component of the upper array 16, an intermediate diameter ball 22 to form a component of the intermediate array, and a small diameter ball 24 to form a component of the lower array. When the plurality of segments are located in position they combine to provide the three arrays as described above.

The support assembly of the invention can be used in an emergency situation where, for example, the drill casing 4 has become stuck during a drilling operation. In such a situation, the support assembly 2 can be installed through the customary riser and blowout preventer stack. The bowl 6 without the support elements 26 is located around the drill casing 4 and lowered by use of a suitable running tool down the outside of the drill casing 4 and through the blowout preventer stack and riser until it engages in the casing head at an intermediate location of the drill string. The most narrow internal diameter of the support bowl 6 at the lip 18 is still sufficiently large to allow the support bowl to be passed over any interconnecting collars of sections of the drill casing. Tension is then applied to the drill casing 4 and the support elements 26 comprising the segments 28 of elastomeric material in which the three arrays of balls are located are then positioned around casing 4 and lowered down the outside of the drill casing 4. Such lowering is also effected by means of a suitable running tool. The support segments are lowered until they contact the upper end of the fixedly-located support bowl 6. The running tool continues to move the support elements 26 downwards and due to the elastic nature of the material from which the segments 28 are manufactured, they are deformed inwardly on engagement with the upper taper 12 of the support bowl 6 and are consequently directed into the annular space 10 between the internal surface of the support bowl 6 and the outer diameter of the casing 4 where they assume the position shown in FIG. 2. Thus any tendency to a downward movement of the casing 4 results in the balls jamming against the casing even more firmly.

Figure 3:
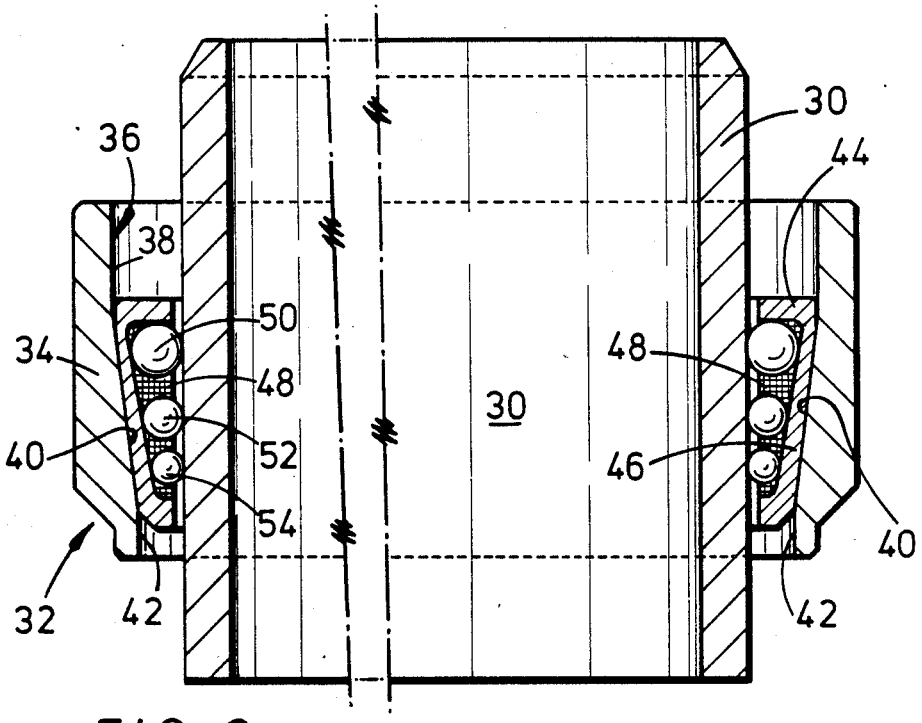
FIG. 3 is a similar view to that of FIG. 2, illustrating a second embodiment.
Figure 4:
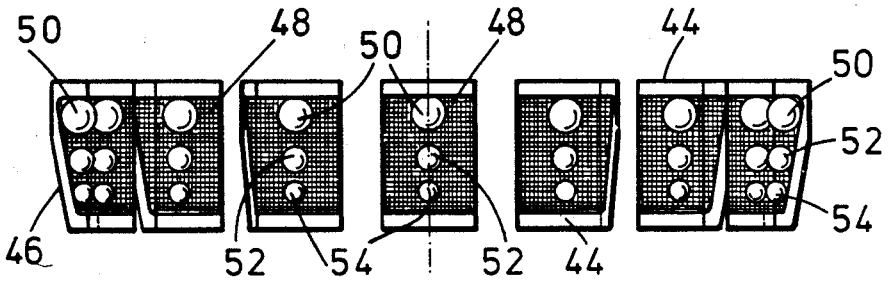
FIG. 4 shows segments of the second embodiment.
Figure 5:
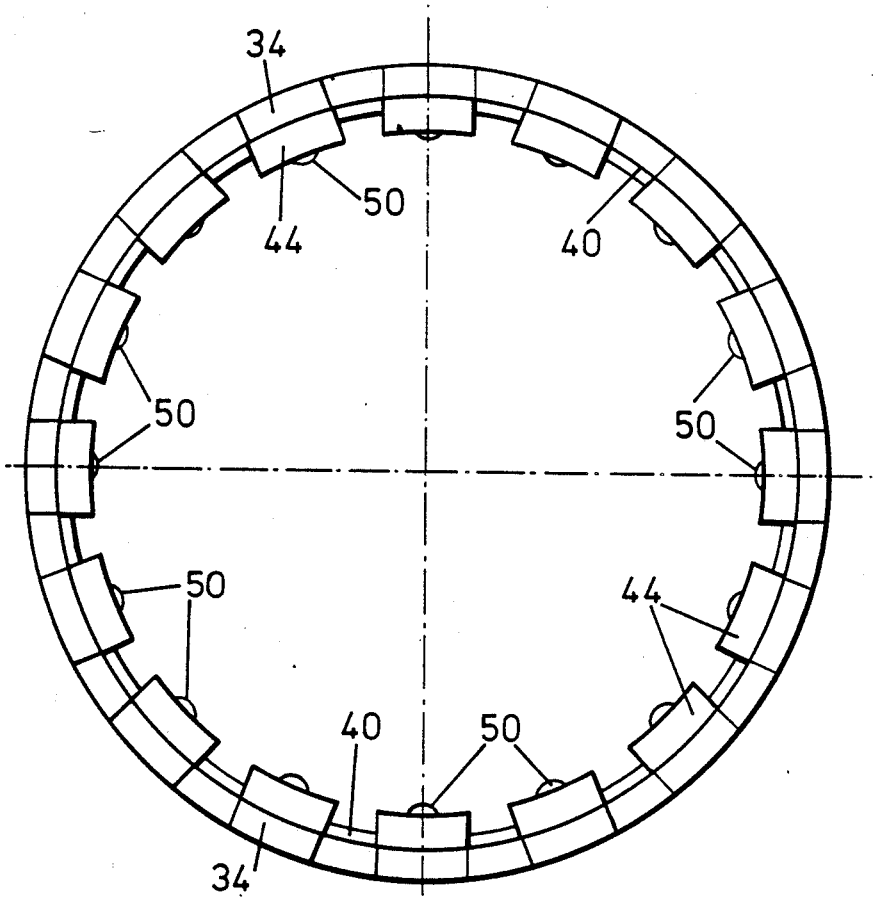
FIG. 5 is a plan view of the second support assembly.

The second embodiment is shown in FIGS. 3 to 5 and shows a drill casing 30 around which is arranged a support assembly 32.

The support assembly consists of a cylindrical bowl 34 having an internal surface 36 the diameter of which is greater than the outer diameter of the casing 30. The surface 36 comprises an upper annular portion 38 which is of substantially constant diameter, an intermediate portion 40 which is of decreasing, tapering diameter, i.e. frustoconical, and a lower portion 42 of a constant diameter, less than that of the portion 38 but, as mentioned above, greater than that of the exterior of the casing 30.

Inserted between the surface portion 40 and the casing 30, by means of a running tool as in the first embodiment, is an annular series of arcuate support elements 44. Each element 44 includes a shell portion 45 provided with a frustoconical external surface portion 46 which tapers at an angle similar to that of the bowl surface portion 40 against which it seats. Partially enclosed by configuration of each element 44 is a support portion 48 made of resilient elastomeric material in which are partially embedded three steel balls 50,52,54 each of lesser diameter than the one positioned above it, in a manner similar to that of the three sizes of members 20,22,24 of the first embodiment.

Eighteen elements 44 are supported around the casing 30 as may be seen in FIG. 5. When so supported, the balls 50 of each element form an upper annular array, the balls 52 an intermediate annular array and the balls 54 a lower annular array.

As in the use of the first embodiment, any movement of the casing 30 in a downwards direction with respect to the fixedly secured assembly 32, results in the arrays of balls becoming even more firmly wedged in place than before, effectively preventing the casing falling free should the obstruction clear.

It will be appreciated that various modifications to the support assembly of the present invention can be made. For example, in the embodiments described above, the support assembly has three arrays of balls. If desired, a greater number of arrays can be employed. In addition, any suitable material for the carrier can also be used. Also, if required the support bowl can be of the split type to allow it to be wrapped around the drill casing.

We claim:

1. A suspension system for use in supporting a tubular member such as a drill casing for use in a wellhead, comprising an annular bowl member having an internal tapered annular surface which reduces in diameter from its upper to its lower end and a support means comprising an annular support element arrangement at least partially formed from resilient material and a plurality of support members at least partially embedded in said resilient material and having a circular cross-section in at least one direction, said members forming a plurality of annular arrays adapted to engage said tapered annular surface and to surround said tubular member, the uppermost of said arrays comprising support members having said circular cross-section larger than that of a lowermost of said arrays.

2. A support system as claimed in claim 1 wherein the support element arrangement comprises a plurality of arcuate elements.

3. A suspension system as claimed in claim 1 wherein there are provided at least three arrays of support members, the diameter of the circular cross-section of the members of each array decreasing stepwise from the diameter of those of the uppermost array to those of the lowermost array.

4. A suspension system as claimed in claim 1 wherein the support members are spherical.

5. A suspension system as claimed in claim 1 wherein the support members are substantially embedded in said resilient material.

6. A suspension system as claimed in claim wherein the support members are partially embedded in the resilient material so as to project therefrom.

7. A suspension system as claimed in claim wherein the resilient material is partially enclosed by a rigid shell portion of the support element.

8. A suspension system as claimed in claim 7, wherein said support element shell portion is provided with a frustoconical, external surface portion, the bowl member having a corresponding frustoconical internal surface portion adapted to be engaged thereby in a wedging manner.

9. A suspension apparatus for supporting a tubular member such as a length of drill casing in a wellhead, comprising:

an annular bowl member having an inwardly facing frusto-conical surface which reduces in diameter from its upper to its lower end;

an annular supporting assembly at least partially formed of resilient material and adapted for engagement with said frusto-conical surface of said annular bowl member;

a plurality of support members at least partially embedded in said resilient material of said annular supporting assembly and spaced apart in arcuate intervals about said annular supporting assembly, said support members having a circular cross section in at least one direction; and at least two spaced apart annular arrays of said support members, the uppermost of said arrays comprising support members having a circular cross section larger than the support members of the lowermost of said arrays.

10. The suspension apparatus of claim 9 wherein said annular supporting assembly is segmented.

11. The suspension apparatus of claim 10 wherein a supporting member from each of said annular arrays is embedded in one of said segments.

12. The suspension apparatus of claim 11 wherein said annular supporting assembly comprises three annular arrays of support members.

13. The suspension apparatus of claim 11 wherein said support members are spherical.

14. The suspension apparatus of claim 9 wherein said annular supporting assembly includes a nonresilient shell portion along its outer periphery, said shell portion including a frusto-conical outer surface adapted to be engaged by said frusto-conical surface of said annular bowl member in a wedging manner.

15. The suspension apparatus of claim 14 wherein said annular supporting apparatus is segmented.

16. The suspension apparatus of claim 15 wherein a supporting member from each of said annular arrays is embedded in one of said segments.

17. The suspension apparatus of claim 16 wherein said annular supporting assembly comprises three annular arrays of support members.

18. The suspension apparatus of claim 17 wherein said support members are spherical.

* * * * *